United States Patent [19]

Miller

[11] Patent Number: 4,932,682

[45] Date of Patent: Jun. 12, 1990

[54] MEDICATION RECORD

[76] Inventor: Lucinda G. Miller, 6027 Sanford, Houston, Tex. 77096

[21] Appl. No.: 260,065

[22] Filed: Oct. 20, 1988

[51] Int. Cl.[5] ..... B41L 1/34; B42F 3/00; B42F 5/00; B42D 15/00

[52] U.S. Cl. ..... 282/3 R; 282/9 R; 282/23 R; 283/900

[58] Field of Search ..... 282/3 R, 9 R, 23 R; 283/900

[56] References Cited

U.S. PATENT DOCUMENTS

| | | | |
|---|---|---|---|
| 3,061,335 | 10/1962 | Cohen | 282/23 R |
| 3,177,010 | 4/1965 | Stroh | 282/23 R |
| 3,233,918 | 2/1966 | Tathwell | 282/9 R |
| 3,625,547 | 12/1971 | Burke | 283/900 |
| 3,960,634 | 6/1976 | Kempster | 283/900 |
| 4,029,341 | 6/1977 | Neill et al. | 283/900 |
| 4,277,089 | 7/1981 | Lockhart | 283/900 |
| 4,502,717 | 3/1985 | Malone | 282/23 R |

*Primary Examiner*—Douglas D. Watts
*Assistant Examiner*—Paul M. Heyrana
*Attorney, Agent, or Firm*—Dodge, Bush & Moseley

[57] ABSTRACT

In accordance with an illustrative embodiment of the present invention, a medication information recording system includes a chart having a series of vertically spaced, partially overlapping prescription slips detachably secured to the left hand margin thereof. The chart has alternating rows of prescription information blocks and related information blocks. Each slip has a row of prescription information blocks superimposed over a companion row on the chart, and a row of pre-printed heading blocks superimposed over a row of related information blocks on the chart. Carbon-less reproduction is made of all entries in the prescription information blocks of the slips onto the chart, whereas related information is entered directly on the appropriate chart blocks immediately below the reproduced information.

9 Claims, 1 Drawing Sheet

MEDICATION RECORD

FIELD OF THE INVENTION

This invention relates generally to a prescription medication recording system, and particularly to a new and improved medication chart having a plurality of prescription slips removably attached thereon and arranged to provide a chronological record of medication data and related information as the individual prescription slips are removed and issued to a patient.

BACKGROUND OF THE INVENTION

Physicians typically issue a drug prescription to a patient by filling out a pad form. Occasionally, one or more carbon copies is made. An original is given to the patient to take to a pharmacist. If a carbon copy was made, that copy is placed in the patient's medical records folder. The filing of the copy is usually intended to be done by an office secretary. Where no copy is made, the physician typically makes a hand entry of pertinent data in the folder.

An accurate historical record of all prescriptions issued to a particular patient is highly important because it enables the physician to monitor possible drug incompatibility and adverse reactions, as well as to keep patients for whom drug metabolism may be problematic due to age and other factors. Immediate detection of inappropriate prescribing such as duplication, inadequate or excessive dosage and inappropriate dosing intervals, of course requires readily accessible and accurate records. A notable amount of a physician's time can be taken up with repeat prescriptions unless a complete medication record for a particular patient can be marshalled without delay.

There also is a need for a prescription recording system that allows entry of other pertinent data such as refill information and discontinuance date, which are recorded together with the prescription so that all relevant information is available from a chart at a glance. Otherwise there is the risk of generating multiple prescriptions which can create diversion problems.

An object of the present invention is to provide a new and improved prescription slip and chart recording combination that allows the making of a copy of pertinent prescription date on the chart without the use of carbon paper.

Another object of the present invention is to provide a new and improved medication record keeping system which allows acquisition and entry of other pertinent data juxtaposed to the prescription data so that all such information is available for review at a glance.

Still another object of the present invention is to provide a new and improved medications data recording system that greatly reduces the possibility of generating multiple prescriptions which can lead to diversion problems.

SUMMARY OF THE INVENTION

These and other objects of the present invention are attained through the provision of a generally rectangular, letter-size medical record chart having a plurality of vertically spaced and partially overlapping drug prescription slips that overlay the front surface of the chart. The front surface of the chart and the back surface of each prescription slip have respective coatings of micro encapsulated chemicals which provide for pressure responsive transfer of entries written on the fronts of the respective slips to underlying areas of the chart, without the use of any carbon paper. Each prescription slip is secured to the left hand margin of the chart by an adhesive, and a line of perforations adjacent the adhesive allows each slip to be readily detached from the chart and issued to the patient upon completion of various entries on the slip by the physician.

The upper portion of each prescription slip has upper and lower lines of information blocks in which the date, drug name, strength, quantity, dosing directions and number of refills are entered by the physician. A separate line of blocks between such upper and lower lines of information blocks contains printed headings indicative of the nature of the information to be placed in the respective blocks of the upper and lower lines. Such heading blocks will not be written on by the physician as the prescription form is completed. These three lines of information blocks overlay identically arranged lines of information blocks on the underlying chart, however the block lines on the prescription slip form are offset downward by one line with respect to the lines of blocks on the chart. In this manner, the line of information blocks on the chart which underlie the printed heading block line of the prescription slip is left blank as one or both of the prescription data block lines are filled in. The blank lines of blocks on the chart provide spaces for the physician to fill in other pertinent data which is not furnished to the patient, such as diagnosis code, refill information, and the reasons and date for discontinuing the medication. The headings for each of these chart blocks is printed inside the block itself.

As consecutive prescription slips are issued to the patient, a continuous, chronological record is made on the underlying chart of all medication's prescribed to that patient, juxtaposed with other pertinent information and data entered by the physician. The chart can be placed in the patient's medical file for ready reference by the physician in making subsequent prescriptions or refills, and provides an extremely useful and complete compendium of medical information respecting the patient.

BRIEF DESCRIPTION OF THE DRAWINGS

The present invention has other objects, features and advantages that will become more readily apparent in connection with the following detailed description of a preferred embodiment, taken in conjunction with the appended drawing in which.

The drawing

DETAILED DESCRIPTION OF A PREFERRED EMBODIMENT

Figures 1, 2:
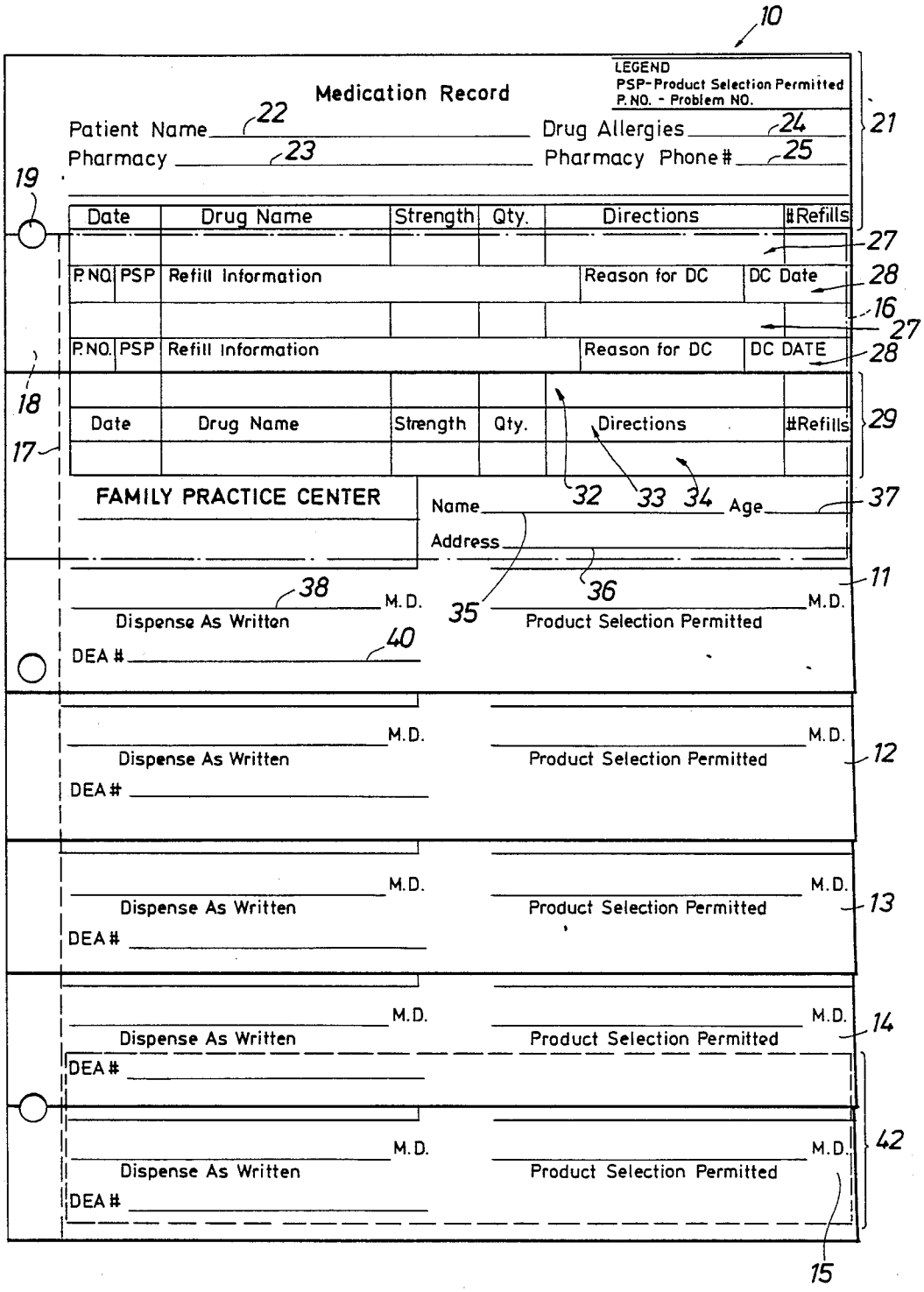
FIG. 1 is a front plan view of the present invention with the uppermost prescription slip having already been removed and issued so as to illustrate the arrangement of information blocks on the underlying chart.
FIG. 2 is a side view showing how the prescription slips are mounted in overlapping relation on the chart.

Referring to the drawing figure, a medication record chart 10 that preferably is made of a suitable rectangular, letter-sized sheet of cardboard has a series of prescription slips 11–15 removably attached to the front side thereof. The prescription slips are made of a suitable paper. For convenience of illustration, the top prescription slip 16 is shown as having already been issued by the physician to the patient after being filled out and then detached along the vertical line of perforations 17 at the left margin thereof. The position of the slip 16 before detachment is shown by dash-dot-dash lines. Each of the prescription slips 11–15 overlaps the slip immediately below it by approximately one-half the width of each slip, and each slip is attached to the left-hand margin of the chart 10 by a layer 18 of a suitable adhesive. If desired, the respective lower and upper left margins of adjacent slips also can be secured by an adhesive. Vertically spaced and aligned holes 19 can be provided, as shown, to allow the chart and any unused slips to be retained in a typical binder which constitutes the medical file of a particular patient.

The chart 10 has a top region 21 with lines 22, 23, 24 and 25 in which the patient's name, the name of the pharmacy, any drug allergies, and the pharmacy phone number are entered. Below the region 21 are formed rows of information on blocks 27, 28 in an alternating fashion. A line 30 of heading blocks apply to the vertical rows of blocks 27 in the alternate lines, such blocks being initially completely blank. The remaining rows of information blocks 28 have printed headings, as shown, in the upper left-hand corner of each block. These blocks are arranged to be filled by the physician with appropriate information to indicate diagnosis code, whether product selection is permitted, refill information, reasons for discontinuance, and discontinuance date. As explained below, this information does not appear on the prescription slip as issued to the patient, but is vital information in the chart 10. It will be noted that such related information blocks are juxtaposed immediately below the prescription information blocks for comparison at a glance.

Each of the prescription slips 11–16 is arranged for entry of information as shown in the drawing for the slip 11. The upper portion 29 of the slip 11 has three rows of information blocks 32–34. The middle row 33 contains pre-printed headings, as shown, indicative of the information to be entered in the respective blocks of the upper and lower rows 32 and 34. Each prescription slip is attached to the underlying chart 10 in a manner such that the middle row 33 directly overlays a chart row 28 of other pertinent information which is filled in by the physician only on the chart. The upper and lower rows 32, 34 which contain the drug prescription information, directly overlay the chart rows 27, so that information and data entered in rows 32 and 34 is duplicated on the chart rows 27.

The lower region of each prescription slip 11–16 contains an appropriate arrangement of information such as the clinic name, address and telephone number, (which can be pre-printed on the form), ,and spaces 35, 36, 37 where the name, address and age of the patient are filled in by the physician. Lines 38 and 39 provide signature lines for the physician, depending upon whether the prescription is to be filled by the pharmacist as written, or whether another drug product can be selected and substituted by the pharmacist. The lower left hand line 40 of each slip is provided for entry of the DEA number.

The back surface of at least the upper portion of each prescription slip, which contains the region 29, and which directly contacts the front surface of the chart 10, is provided with a suitable coating of micro encapsulated chemical. The entire front surface of the chart 10 also is coated with a micro encapsulated chemical. When the localized pressure of a writing instrument is applied as entries are made on the prescription slip, affected capsules are burst, allowing chemical mixing which provides a reproduction of the entries on the chart without the use of carbon paper. Thus all entries in the lines 32 and 34 will be reproduced on the lines 27 of the chart 10 in order to duplicate the slip entries on the chart. Since the line of blocks 33 is filled with pre-printed headings, no entries are made by the physician on this line, so that the underlying line 28 on the chart 10 is left blank as the prescription slip is filled out. Data and information appropriate for the chart line 28 is filled in directly on these lines by the physician for ready reference at a subsequent date.

A bottom portion 42 of the chart 10, as shown in dash-x-dash lines in the drawing, provides a region where any general comments can be entered by the physician. Otherwise, the lines 27, 28 appear in alternating fashion from below the region 21 to above the region 42.

Through use of the present invention, the entire medication prescription history is available to the physician in the patient's file, in chronological order, so that it can be quickly reviewed. Thus the physician can easily monitor possible drug incompatibility in the event of an adverse drug reaction, and any inappropriate prescribing can be readily detected. Repeat prescriptions can be issued in an expeditious manner. Other pertinent data not shown on the slip issued to the patient but entered on the lines 28 is juxtaposed directly below the prescription information, and also can be seen at a glance. The risk of generating multiple prescriptions is reduced to a minimum, so that diversion problems also are reduced.

Although a letter-size chart has been illustrated in the drawing, another size of chart can be used. The vertical heights of the prescription and related information blocks can be reduced to allow more prescription slips to be attached to the chart, and of course more or less, and different width, blocks can be used, depending upon the amount and detail of the information.

It now will be recognized that a new and improved drug prescription and data recording system has been disclosed. Since certain changes or modification may be made in the disclosed embodiment without departing from the inventive concepts involved, it is the aim of the appended claims to cover all such changes and modifications falling within the true spirit and scope of the present invention.

What is claimed is:

1. A medication information recording system comprising: a generally rectangular chart having rows of medication prescription information blocks arranged in an alternating manner with rows of related information blocks; a plurality of prescription slips overlaying said chart and arranged to partially overlap one another, each of said slips being removably attached to the left-hand margin of said chart; the upper portion of each slip having a row of medication prescription information blocks identical in arrangement to said row of medication prescription information blocks of said chart and directly overlaying same, and a row of printed headings for said medication information blocks which directly overlay said row of related information blocks on said chart; and means for reproducing entries written in said prescription information blocks of each slip on the underlying prescription information blocks on said chart, whereby said prescription slips can be filled out and issued to a patient and then said related information blocks on said chart can be filled in by the physician to provide a complete and chronological chart record of the medications prescribed by a physician to a particular patient.

2. The system of claim 1 wherein said reproducing means comprises chemical coatings on the back surfaces of said slips and the front surface of said chart.

3. The system of claim 1 wherein said chart has an upper portion located above the uppermost one of said prescription slips and visible thereabove for entering the name and related information concerning a patient.

4. The system of claim 3 wherein said chart has a lower portion located underneath the lowermost one of said prescription slips for the entry of comments of a physician.

5. The system of claim 1 wherein the lower portion of each prescription slip is provided with spaces for the entry of the name of the patient and the signature of the physician.

6. The system of claim 1 wherein the upper portion of each prescription slip has another row of medication prescription information blocks located immediately below said row of printed headings.

7. A medication record-keeping device for use by a physician in issuing prescriptions to a patient while constructing a chart showing the medication history of such patient, comprising: a generally rectangular, substantially letter size cardboard medication chart having an upper region with a plurality of blank lines adapted to be filled in with information peculiar to a particular patient, and a lower region providing ample space for written comments of a physician, said chart having a left-hand margin, the area of said chart between said upper region and said lower region and to the right of said margin having a series of rows of information blocks arranged in alternating fashion, one of said alternating rows having blank blocks to be imprinted with prescription information and the other of said alternating rows having printed headings in an upper corner of each block to enable a physician to fill in each block with related information and data immediately adjacent to and below each of said blank blocks; a vertically arranged series of individual prescription slips mounted on said chart below said upper region thereof, each of said slips having a left hand margin secured to said left hand margin of said chart by adhesive means, there being a vertical line of perforations formed in each of said slips immediately to the right of said margin to enable each individual slip to be readily detached from said chart at said line of perforations, each of said slips having an upper portion thereof laying directly against said chart, and each of said slips except the lower one thereof having a lower portion that overlaps the upper portion of the next adjacent slip therebelow; said upper portion of each prescription slip having a first horizontal row of blank prescription information blocks that is superimposed over a blank row of identical size information blocks on said chart, and a row of printed heading blocks which is superimposed over a row of related information blocks on said chart; and means on the front surface of said chart and the rear surface of each of said prescription slips for reproducing entries made by a physician in each block of each row of the prescription information blocks on each of said slips on the underlying prescription information blocks of said chart, said other rows of blocks on said chart providing space for direct written entry by a physician of related information which appears only on said chart and immediately below said blocks of reproduced prescription information.

8. The device of claim 7 where said upper portion of each prescription slip has a second horizontal row of blank prescription information blocks immediately below said row of printed heading blocks which also is superimposed over a row of related information blocks on said chart, whereby multiple medication prescriptions can be issued with each of said slips.

9. The device of claim 8 wherein the second one of said series of individual prescription slips is mounted on said chart in a manner such that the upper edge thereof coincides with the bottom of the second one of said rows of related information blocks.

* * * * *